United States Patent [19]

Defretin et al.

[11] 4,314,907

[45] Feb. 9, 1982

[54] OIL ADDITIVE COMPOSITIONS FOR INTERNAL COMBUSTION ENGINES

[75] Inventors: Francis Defretin, Halluin; Jean-Paul Eudeline, Boulogne Billancourt; Elisabeth Schoch, Rambouillet; Alain Voisin, Farbus, all of France

[73] Assignee: PCUK Produits Chimiques Ugine Kuhlmann, Courbevoie, France

[21] Appl. No.: 92,080

[22] Filed: Nov. 6, 1979

[30] Foreign Application Priority Data

Nov. 7, 1978 [FR] France ..... 78 31421

[51] Int. Cl.[3] ..... C10M 3/02; C10M 3/42

[52] U.S. Cl. ..... 252/22; 44/51; 44/66; 44/68; 252/29; 252/32.7 E

[58] Field of Search ..... 252/22, 29, 32.7 E, 252/25, 18; 44/51, 68, 66

[56] References Cited

U.S. PATENT DOCUMENTS

| | | | |
|---|---|---|---|
| 3,242,075 | 3/1966 | Hunter | 252/22 |
| 3,607,747 | 9/1971 | Ishikawa et al. | 252/18 |
| 3,856,686 | 12/1974 | Sato et al. | 252/29 |
| 3,933,659 | 1/1976 | Lyle et al. | 252/32.7 E |
| 3,988,137 | 10/1976 | Goodwin | 252/22 |
| 4,089,792 | 5/1978 | Lowe | 252/32.7 E |
| 4,139,474 | 2/1979 | Watanabe et al. | 252/25 |
| 4,162,985 | 7/1979 | Holubec | 252/32.7 E |
| 4,168,241 | 9/1979 | Kozima et al. | 252/18 |
| 4,201,683 | 5/1980 | Brewster | 252/32.7 E |

*Primary Examiner*—Jacqueline V. Howard
*Attorney, Agent, or Firm*—Pennie & Edmonds

[57] ABSTRACT

Oil additive compositions for internal combustion engines, containing at least one dithiophosphate, at least one fatty amide and a fluorographite $CF_x$, where x is between about 0.6 and 1, and oils containing such compositions.

11 Claims, No Drawings

OIL ADDITIVE COMPOSITIONS FOR INTERNAL COMBUSTION ENGINES

TECHNICAL FIELD

Additive compositions for oils intended for use as lubricating and/or fuels in internal combustion engines and oils containing such additives.

BACKGROUND ART

One of the essential concerns of internal combustion engine makers and of motor oil manufacturers is to develop new mechanical methods and new lubricating compositions making it possible to reduce wear and/or fuel consumptions.

It has, in particular, been sought to lessen the viscosity of the lubricating oil base, but the risk is then premature wear of the engines. To reduce that wear, it has been proposed that products be used to adjust the viscosity of oils, such as polymethacrylates, polyisobutylenes and the so-called antiwear additives with a sulfur, phosphorus and a heavy metal base like metal dithiophosphates.

The viscosity regulators have the disadvantage of being sheared on use, which reduces their effect, and of breaking down thermally, forming varnishes harmful to engine endurance. Furthermore, the sulfur, phosphorus and heavy metal base antiwear additives have a limited lifetime.

It has also been proposed that microdispersions of solid lubricants, such as molybdenum disulfide ($MoS_2$) and graphite, be added to oils as antiwear additives, but the results are poor as far as the fuel economy obtained is concerned.

An appreciable improvement has been made by reinforcing the action of sulfur, phosphorus and heavy metal base additives with polar derivatives, such as esters of fatty acids and alcohols, e.g., isopropyl oleate.

DISCLOSURE OF THE INVENTION

The additive compositions of this invention makes it possible to increase considerably the lubricant properties of oils as well as fuel economies which, according to the type of engine, can range from 5 to 12% as well as stabilization of oil and water temperatures at a value 5° C. to 10° C. below what it is with the oil currently used.

The additive compositions of this invention are mixtures containing at least one dithiophosphate, at least one fatty amide and a fluorographite.

The dithiophosphates (DTPM) are compositions which can be represented by the chemical formula:

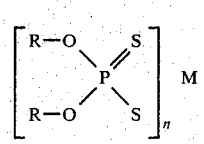

(I)

in which R is an organic, alkyl or aryl radical and M a metal cation such as $Cu_{II}$, $Ag_{I}$, $Zn_{II}$, $Cd_{II}$, $Pb_{II}$ or a nonmetallic or organic radical, e.g., derived from ethylenediamine. The R or M organic radicals can vary in the number of carbon atoms and can be substituted or unsubstituted so long as they do not interfere with the dispersibility of the dithiophosphates in the oils or otherwise interfere with their intended function and advantageous results in the oils.

The use of dithiophosphates where M is a metal are particularly recommended as a result of the high temperature stability of these products and, in particular, the use of zinc dithiophosphates. Among the other (I) products particularly recommended, dithiocarbamates and dialkylphosphorodithioates can be mentioned.

The proportions of dithiophosphates to be introduced in motor oils with the composition additives according to the invention vary with the types of oil. It is generally recommended that between about 0.05% and 0.2% dithiophosphate be used, expressed in M cations by weight of the base oil. It is to be noted that these proportions are higher than those currently used in the commercial antiwear oil of 0.03% to 0.07% expressed in M cations.

The second constituent of the compositions of this invention is a fatty amide and, in particular, an aliphatic amide, the fatty chain of which contains from about 8 to 36 carbon atoms, corresponding to the following formula:

R—CO—NH—R or

R—CO—[NR'—R''—NR']—CO—R where R is a saturated or unsaturated hydrocarbon group having from 8 to 36 carbon atoms, R' is hydrogen or the group COR and R'' is an alkylene group having from 2 to 6 carbon atoms. Particularly significant results have been obtained with oleic diamides, such as those formed by reaction alkylene diamines, e.g., ethylene diamine with 1 to 4 mols of oleic acid, but lauric laurylamide, alkanoamides and oxo acid amides are also advantageous. The fatty amide content to be introduced in the composition varies with the type of oil and should generally correspond to between about 0.05% and 1% by weight of the base oil.

For economic reasons, it is generally preferable to produce the amide in situ in the composition by adding the products from which it is prepared, namely, the fatty acid and amine or corresponding salt. On the first few hours of operation of internal combustion engines, reactants contained in the oil are converted into the corresponding amide. The fatty amide content to be used is advantageously between about 0.05% and 1% by weight of the base motor oil.

The third constituent of the additive is a fluorographite, a solid lubricant of formula $CF_x$, where the carbon used for the synthesis of $CF_x$ is natural graphite or artificial graphite, coke or activated carbon, and where x ranges between about 0.6 and 1 and, preferably, between 0.8 and 1.

It is recommended, in order to arrive at a good dispersion of the fluorographite, that it be previously microdispersed in a dispersing medium miscible with oils and, in particular, in polyglycol ethers or mineral oils. Polyglycol ethers of 20 to 400 centistokes viscosity at 40° C. and, in particular, of 100 centistokes viscosity have proven especially appropriate.

The $CF_x$ content of the compositions can vary with the effect desired and generally corresponds to 0.01% to 1% by weight of $CF_x$ in the motor oil and, preferably, to 0.02% to 0.5%.

The synergy encountered between the different constituents of the engine additive compositions disclosed are particularly significant.

Comparative tests have, for example, shown that the addition to the first constituents of the composition, dithiophosphate and fatty amide or fatty acid-amine salt, of a well-known solid lubricant such as molybdenum sulfide, which is very often used in combination with graphites, leads to results very much inferior to those obtained by the addition to these same constituents of graphite fluoride.

The compositions according to the invention are prepared by simple mixture of their constituents. The addition of these compositions to motor oils is made without difficulty by simple introduction in these oils of the additive composition previously prepared.

BEST MODE FOR CARRYING OUT THE INVENTION

The following examples illustrate nonlimitatively the value of the additive compositions according to the invention to be added to oils for internal combustion engines. These examples correspond to laboratory tests conducted using the standard oil testing machines, which are the shell four-ball, Faville and Reichert machines, and practical tests run on the highway with gasoline or diesel engine vehicles of common types.

EXAMPLE 1

Laboratory Tests

Lubricant compositions with the formulas assembled in Table I are prepared from the following constituents:

A. Base oil consisting of a mixture of:

| | |
|---|---|
| 500 neutral | 95% by weight |
| Bright stock solvent (BSS) | 5% by weight |

B. Additive 1:

2% by weight of zinc dithiophosphate with 10% zinc;

1% of a mixture containing 70% BSS and

30% oleic diamine dioleate (the reaction production of $C_{17}H_{33}$—CO—NH$(CH_2)_3$—$NH_2$ with two mols of oleic acid, namely,

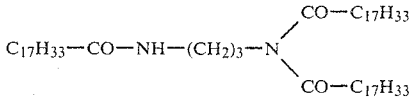

C. Additive 2:

a microdispersion of graphite fluoride $CF_{0.9}$ of 10% by weight in a polyglycol ether of 100 centistokes viscosity at 40° C. or, for test 8, a microdispersion of 10% molybdenum disulfide in a polyglycol ether.

TABLE I

Composition of lubricants studied - % by weight

| Compositions | A Base Oil | B Additive 1 | C Additive 2 |
|---|---|---|---|
| 1 | 100 | 0 | 0 $CF_{0.9}$ |
| 2 | 99 | 0 | 1 $CF_{0.09}$ |
| 3 | 98.5 | 1.5 | 0 $CF_{0.9}$ |
| 4 | 97 | 3 | 0 $CF_{0.9}$ |
| 5 | 97.5 | 1.5 | 1 $CF_{0.9}$ |
| 6 | 96 | 3 | 1 $CF_{0.9}$ |
| 7 | 92 | 3 | 5 $CF_{0.9}$ |
| 8 | 97.5 | 1.5 | 1 $MoS_2$ |

Composition 1 is the base oil alone, undoped. Compositions 3 and 4 contain the base oil and additive 1, zinc dithiophosphate and fatty amide, and composition 2 contains the base oil and additive 2, fluorographite. Compositions 5, 6 and 7 contain the base oil, additive 1, dithiophosphate and fatty amide, and additive 2, graphite fluoride, and in composition 8 the fluorographite of composition 5 is replaced by molybdenum disulfide.

The different compositions of Table I are prepared without difficulty by simple addition to the base oil of the different additives involved. Their properties are examined in standard fashion by means of tests conducted on the shell four-ball, Faville and Reichert machines.

Tests with the Shell four-ball machine

This machine indicates the effectiveness of a lubricant in preventing wear under applied loads.

Three balls locked in a cup containing the lubricant are subjected by means of the fourth ball integral with an engine shaft turning at fixed speed to a known and variable vertical load. The trace of wear formed on the three stationary balls is measured and, as a function of the load, the wear load index (WLI) is determined according to ASTM standard D 2783, and the higher the WLI, the better the lubricant.

The seizure load in kg corresponding to a sharp rise in wear beyond the value predictable and the welding load in kg, defined as the pressure at which the four balls are welded together, are also observed.

All of the tests were performed by applying increasing loads for 10 seconds each.

The results of the tests conducted on the different compositions are assembled in Table II.

TABLE II

Examination of lubricants on the Shell 4-ball machine

| Compositions | Wear Load Index (WLI) | Seizure Load in kg | Welding Load in kg |
|---|---|---|---|
| 1 | 32.5 | 100 | 160 |
| 2 | 31.2 | 80 | 250 |
| 3 | 40.9 | 100 | 200 |
| 4 | 43.2 | 100 | 250 |
| 5 | 44.3 | 100 | 315 |
| 6 | 44.2 | 100 | 315 |
| 7 | 47.1 | 100 | 400 |
| 8 | 39.4 | 100 | 250 |

The influence of graphite fluoride on the welding load is observed; while the addition of 0.1% molybdenum sulfide to the base oil (composition 8) results in a welding load of 250 kg, the addition of 0.1% graphite fluoride, that is, 1% additive 2 (composition 5), results in a welding load of 315 kg. It will also be noted that the wear load index rises very appreciably with the addition of graphite fluoride. With composition 3, where the base oil is already doped with a zinc dithiophosphate and diamine oleate additive, the wear load index is 40.9 and rises to 44.3 with the addition of 0.1% graphite fluoride (composition 5).

Tests with the Faville machine

This machine is used to determine the antiwear properties.

A cylindrical test piece connected to an engine shaft turning at variable speed (from 120 to 3,000 rpm) is inserted between two jaws on which a variable pressure is exerted. The test piece-jaws assembly is immersed in the liquid or sprayed with the same liquid. During application of the load, the tangential load torque is registered from which the coefficient of friction is determined. The weight losses of the test piece and of the jaws are also determined. The test conducted is an endurance test in which increasing loads are applied over a given time. The test is run under the following conditions:

| | |
|---|---|
| speed | 178 rpm |
| test piece and jaws | 16 NC6 steel |

application of loads:

| | |
|---|---|
| 9 bars | 3 min |
| 15 bars | 1 min |
| 23 bars | 1 min |
| 30 bars | 40 min |
| quantity of oil involved | 80 cc |

The test piece-jaws assembly is sprayed with the oil continuously. The oil circulation is at constant speed.

The results obtained on the Faville machine are compiled in Table III.

TABLE III

Examination of lubricants on the Faville machine

| Compositions | Coefficient of Friction 9 bars | 15 bars | 23 bars | 30 bars | Loss in mg Test piece | Jaws | |
|---|---|---|---|---|---|---|---|
| 1 | 0.135 | 0.110 | 0.130 | 0.130 | 10.5 | 2.7 | 3 |
| 2 | 0.140 | 0.124 | 0.130 | 0.120 | 7.5 | 0.4 | 0 |
| 3 | 0.120 | 0.120 | 0.120 | 0.115 | 3.8 | 1.4 | 1 |
| 4 | 0.110 | 0.100 | 0.200 | 0.115 | 5 | 0.8 | 1 |
| 5 | 0.120 | 0.124 | 0.133 | 0.140 | 2.1 | 0.2 | 0.5 |
| 6 | 0.105 | 0.105 | 0.115 | 0.110 | 1.5 | 0.4 | 0 |
| 7 | 0.090 | 0.100 | 0.110 | 0.105 | 0.2 | 0 | 0.2 |
| 8 | 0.135 | 0.124 | 0.150 | 0.140 | 9 | 1 | 0.5 |

It is observed that the simultaneous presence of zinc dithiophosphate, amine oleate and graphite fluoride (compositions 6 and 7) appreciably lowers the value of the coefficient of friction and considerably reduces the wear measured by the weight loss of the test piece and of the two jaws.

While with the zinc dithiophosphate and amine oleate (composition 3), there are respective weight losses of 3.8, 1.4 and 1, with the addition of graphite fluoride (composition 5), the losses are no more than 2.1, 0.2 and 0.5 respectively.

It is also to be noted that the addition of molybdenum sulfide leads to mediocre results.

Tests on the Reichert machine

This machine is used to study the wear due to friction of metal parts, that is, the resistance of the lubricating film.

A ring dipping halfway into the fluid to be examined turns at the fixed speed of 900 rpm; it is in contact with a stationary cylinder on which is applied a load of 1,500 g (that is, 15,000 kg/cm2 Hertz contact pressure). The ring turns for a given time corresponding to a 100 m straight path of the ring (or expressed in time at 1 minute). At the end of that time, an ellipsoidal wear impression is formed on the cylinder. The area of the impression is measured and the load capacity of the lubricant is determined from same. The load capacity, which is the ratio of load in kg to area of the impression in cm2, is also determined.

The test results are compiled in Table IV.

TABLE IV

Examination of lubricants on the Reichert machine

| Compositions | Impressions mm2 | Load kg | Load Capacity kg/cm2 |
|---|---|---|---|
| 1 | 35.3 | 30 | 90 |
| 2 | 29 | 30 | 104 |
| 3 | 17.7 | 30 | 170 |
| 4 | 10 | 30 | 300 |
| 5 | 14.3 | 30 | 210 |
| 6 | 9.5 | 30 | 316 |
| 7 | 7.5 | 30 | 400 |

It is observed that the load capacity of the base oil, which increases considerably upon the addition of zinc dithiophosphate and diamine oleate is further augmented by the introduction of graphite fluoride. One thus passes, for example, from a load capacity of 90 kg/cm2 in the base oil (composition 1) to 170 kg by addition of zinc dithiophosphate and oleate (composition 3) and to 210 kg by a further addition of 0.1% graphite fluoride (composition 5). Composition 7, containing 3% additive 1 and 5% additive 2, that is, 0.5% by weight of fluorographite, results in a remarkable load capacity of 400 kg/cm2.

The set of tests conducted shows that the motor oil additive compositions according to the invention present a group of particularly valuable properties, increase of welding load and of load capacity of the lubricant and reduction of wear of metal parts in friction, which results in a diminution of the internal friction coefficient of the engines and of engine wear.

EXAMPLE 2

Tests on motor vehicle with gasoline engine

A Renault 16 TS car of standard type, the engine of which had run for 9,000 km, was used with two passengers to conduct a super gasoline consumption test with a regular commercial motor oil and then, by comparison, with that same oil having a lubricant additive composition incorporated according to the invention.

These tests were conducted on an expressway at a constant speed of 120 km/h. The following routes were covered:

Paris-Poitiers, round trip, 557.8 km, without additive.

The oil is drained from the car and filled with 4 liters of Labo oil. 100 g of an additive consisting of a mixture of 60% additive 1, defined in Example 1, and 40% additive 2, defined in Example 1, is added to the Labo oil. The car was then driven for 416 km over the Paris-Dieppe expressway to attain optimum efficiency of the additive.

Paris-Poitiers, round trip, with the motor oil preloaded with additive, as indicated, that is, 558.9 km.

The results obtained in the course of that consumption tests are assembled in Table V. It is to be noted that in the Poitiers-Paris trips a stable wind was blowing in a north-south direction.

The fuel saving obtained in the course of that test by addition to the motor oil of an additive composition according to this invention averages 5.4%.

TABLE V

EXPRESSWAY CONSUMPTION TEST
With a Renault 16TS car - gasoline engine with and without additive.

| | Distance in km covered at 120 km/h | Time in minutes | Super gasoline consumption in liters | Hourly average in km/h | Super gasoline consumption per 100 km |
|---|---|---|---|---|---|
| | | I. Without Additive | | | |
| one-way | 315.5 | 158 | 36.3 | 120.00 | 11.5 |
| return trip | 242.3 | 121 | 33.2 | 120.06 | 13.7 |
| Total | 557.8 | 279 | 69.5 | 120.03 | 12.5 |
| | | II. With Additive | | | |
| one-way | 316.6 | 158 | 33.7 | 120.0 | 10.6 |
| return trip | 242.3 | 121 | 32.1 | 120.5 | 13.3 |
| Total | 558.9 | 279 | 65.8 | 120.2 | 11.8 |
| Fuel Saving: | one-way | = 7.5% | | | |
| | return trip | = 3.1% | | | |
| | round trip | = 5.4% | | | |

EXAMPLE 3

Test on motor vehicle with Diesel engine

A Citroen CX Diesel 2500 D car of standard type, the engine of which had run for 3,500 km, was used to conduct a gas oil consumption test with a regular commercial oil, TOTAL 20W40 oil, and then, by comparison, with that same oil having a lubricant additive composition incorporated, according to the invention.

The consumption test was conducted over the Lille-Le Puy route, round trip, covering a total of 1,300 km of expressway and 400 km of mountainous national highway, at a speed varying with the sections and traffic congestion, but averaging 120 km/h on the expressway and 70 km/h on the national highway.

On the way out one person used the car and gas-oil consumption was 8.1 liters per 100 km. Before the return trip, which was made with five persons in the car, there were incorporated in the five liters of oil 200 g of an additive having the following composition:

75% additive 1, defined in Example 1, and

25% additive 2, defined in Example 1.

Gas-oil consumption on the return trip was 7.2 liters per 100 km, which corresponds to a fuel economy on 11%.

We claim:

1. An oil additive composition for internal combustion engines consisting essentially of at least one metal dithiophosphate, at least one fatty amide, where the fatty amide has the formula:

$$R—CO—NH—R$$

or $$R—CO—[NR'—R''—NR']—CO—R$$

where R is a saturated or unsaturated hydrocarbon group having from 8 to 36 carbon atoms, R′ is hydrogen or the group COR and R″ is an alkylene group having from 2 to 6 carbon atoms, and a fluorographite $CF_x$, where x is between about 0.6 and 1.

2. Compositions according to claim 1, where the dithiophosphate is zinc dithiophosphate.

3. Compositions according to claim 1 where the fatty amide is an oleic acid amide.

4. Compositions according to one of claims 1 or 3 where the fatty amide is produced in situ in the oil by adding a mixture of fatty acid and amine or the corresponding salt.

5. Compositions according to one of claims 1 or 3 where in the fluorographite $CF_x$ used, x is between about 0.8 and 1.

6. Compositions according to one of claims 1 or 2 where the fluorographite used is microdispersed in a dispersing medium miscible with oils for internal combustion engines.

7. Compositions according to claim 6 where the fluorographite used is microdispersed in a polyglycol ether of 100 centistokes viscosity at 40° C.

8. Oils for internal combustion engines comprising a base oil having an additive composition according to one of claims 1 or 2 admixed therein.

9. Oils, according to claim 8, containing from 0.05% to 0.2% by weight dithiophosphate, expressed in cations of dithiophosphate.

10. Oils, according to claim 8, containing from 0.05% to 1% by weight of a fatty amide or mixture of fatty acid and amine or the corresponding salt.

11. Oils, according to claim 8, containing from 0.01% to 1% by weight $CF_x$ where x is between about 0.6 and 1.

* * * * *

UNITED STATES PATENT AND TRADEMARK OFFICE

CERTIFICATE OF CORRECTION

PATENT NO. : 4,314,907

DATED : February 9, 1982

INVENTOR(S) : Francis Defretin, et al.

It is certified that error appears in the above—identified patent and that said Letters Patent is hereby corrected as shown below:

Column 3, line 22, reads "shell", should read --Shell--.

Column 4, line 10, reads "shell", should read --Shell--.

Column 7, line 44, reads "on 11%", should read --of 11%--.

Column 8, line 27, Claim 6, reads "claims 1 or 2", should read --claims 1 or 3--.

Column 8, line 36, Claim 8, reads "claims 1 or 2", should read --claims 1 or 3--.

Signed and Sealed this

*Twenty-fifth* Day of *May 1982*

[SEAL]

*Attest:*

*Attesting Officer*

GERALD J. MOSSINGHOFF

*Commissioner of Patents and Trademarks*